US008439401B2

(12) United States Patent
Groves et al.

(10) Patent No.: US 8,439,401 B2
(45) **Date of Patent: *May 14, 2013**

(54) CAUTION POLE

(75) Inventors: Brad Groves, Rockford, IL (US); Parker Richard, Prospect, KY (US)

(73) Assignee: Fiberglass Innovations, LLC, Rockford, IL (US)

( * ) Notice: Subject to any disclaimer, the term of this patent is extended or adjusted under 35 U.S.C. 154(b) by 362 days.

This patent is subject to a terminal disclaimer.

(21) Appl. No.: 12/774,796

(22) Filed: May 6, 2010

(65) Prior Publication Data

US 2010/0212578 A1 Aug. 26, 2010

Related U.S. Application Data

(63) Continuation-in-part of application No. 12/399,753, filed on Mar. 6, 2009, now Pat. No. 7,748,745, which is a continuation of application No. 11/328,844, filed on Jan. 10, 2006, now Pat. No. 7,644,953.

(60) Provisional application No. 60/645,090, filed on Jan. 19, 2005.

(51) Int. Cl.
*A63C 11/00* (2006.01)

(52) U.S. Cl.
USPC ..... 280/821; 280/819; 52/103

(58) Field of Classification Search ..... 280/821, 280/819, 809, 813, 826; 52/103, 155, 165, 52/98; 248/674, 300
See application file for complete search history.

(56) References Cited

U.S. PATENT DOCUMENTS

| | | | | | |
|---|---|---|---|---|---|
| 1,263,327 | A | * | 4/1918 | Kristofer | 24/11 M |
| 1,404,863 | A | * | 1/1922 | Klenck | 24/11 M |
| 1,950,298 | A | | 3/1934 | Frost | |
| 2,779,240 | A | | 1/1957 | Gaydos | |
| 3,279,133 | A | | 10/1966 | De Korte | |
| 3,378,967 | A | * | 4/1968 | Baumeister | 52/98 |
| 3,503,163 | A | * | 3/1970 | Lutz | 52/103 |
| 3,507,081 | A | | 4/1970 | Gallup | |
| 3,916,821 | A | | 11/1975 | Pies | |
| 4,254,597 | A | * | 3/1981 | Feldman et al. | 52/103 |
| 4,270,873 | A | | 6/1981 | Laehy et al. | |
| 4,343,567 | A | | 8/1982 | Sarver et al. | |
| 4,441,288 | A | * | 4/1984 | Feldman et al. | 52/103 |
| 4,486,117 | A | | 12/1984 | Blau | |
| 4,502,258 | A | | 3/1985 | Rushing | |
| 4,977,851 | A | | 12/1990 | Anderson | |
| 5,029,783 | A | | 7/1991 | Alvarez | |
| 5,090,348 | A | | 2/1992 | Hugron | |
| 5,148,641 | A | * | 9/1992 | Rushing et al. | 52/103 |
| 5,207,175 | A | | 5/1993 | Andonian | |
| 5,273,371 | A | * | 12/1993 | Hugron | 404/10 |
| 5,291,703 | A | | 3/1994 | Ziegler | |
| 5,507,589 | A | | 4/1996 | Jacobs | |

(Continued)

*Primary Examiner* — Hau Phan
(74) *Attorney, Agent, or Firm* — Stoll Keenon Ogden PLLC; Rebecca Ann Krefft

(57) ABSTRACT

A caution pole for embedding in a support medium for drawing attention to potential hazards includes a generally elongate pole body with a proximate end portion formed with a pointed tip for insertion into a support medium, a metal impact cap fitted over the end opposite the proximate end portion of the pole body, the impact cap including a generally cylindrical body having an access opening on one end thereof and a substantially planar surface opposing the access opening, and a clip disposed on the pole body having a base and an arm capable of securing an attachment to the caution pole.

30 Claims, 8 Drawing Sheets

U.S. PATENT DOCUMENTS 5,624,210 A 4/1997 Baldwin et al.
5,704,583 A * 1/1998 Putland et al. ..... 248/674
6,514,006 B1 2/2003 Hines
6,772,565 B1 * 8/2004 Schiltz et al. ..... 52/155
7,644,953 B2 * 1/2010 Groves ..... 280/821
7,748,745 B2 * 7/2010 Groves ..... 280/821

* cited by examiner

CAUTION POLE

CROSS-REFERENCE TO RELATED APPLICATIONS

The present application is a continuation-in-part of U.S. patent application Ser. No. 12/399,753 titled "Hammer Driven Snow Pole" filed Mar. 6, 2009, which is a continuation of U.S. patent application Ser. No. 11/328,842 titled "Hammer-Driven Snow Pole" filed Jan. 10, 2006, which issued as U.S. Pat. No. 7,644,953 on Jan. 12, 2010, which claims the benefit of U.S. Provisional Patent Application Ser. No. 60/645,090 titled "Hammer-Driven Snow Pole" filed Jan. 19, 2005.

MULTIPLE EMBODIMENTS AND ALTERNATIVES

Figure 1:
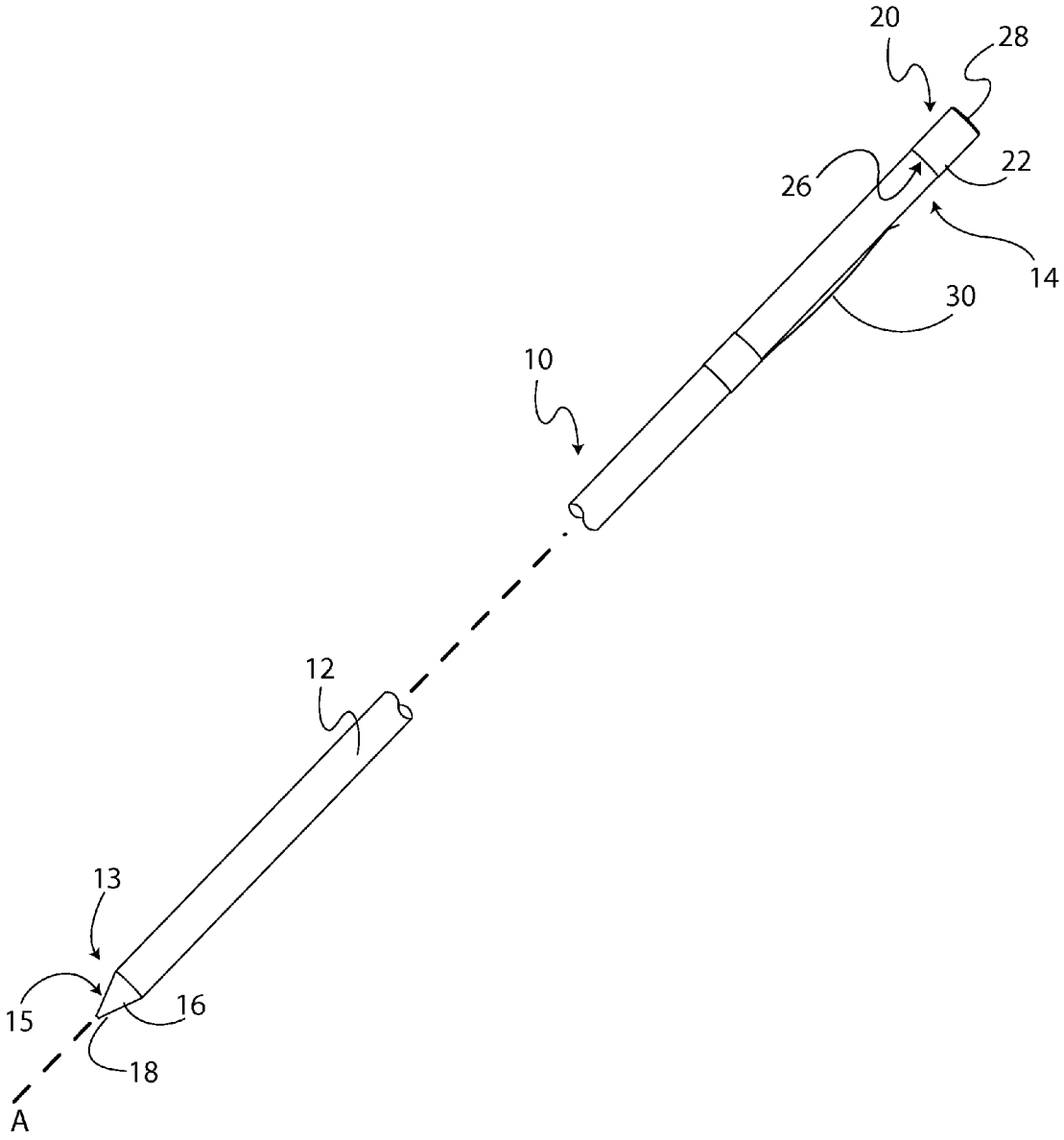
FIG. 1 is a perspective view of a caution pole with a pointed tip according to multiple embodiments and alternatives.

Turning now to the drawings and, more particularly to FIG. 1, a caution pole according to multiple embodiments and alternatives is illustrated generally at 10 and includes an elongate, thin pole body 12 formed from fiberglass, plastic or other lightweight, resilient and weather-resistant material extending along a longitudinal axis A thereof. It will therefore be readily understood that the material composition of the pole body 12 relates directly to mechanical function and not merely to ornamentation. The material composition of the pole body 12 provides the shock transmission necessary to efficiently allow a user to drive the caution pole 10 into the ground. The material composition of the pole body 12 also provides durability and facilitates repeated and continued use of the caution pole 10 year after year. The material composition also provides a lightweight and weather-resistant caution pole 10. The material optionally may be brightly colored so as to be fluorescent, and may be green, orange, yellow, or some other high visibility color. The fluorescent surface provides high visibility for the caution pole 10 in adverse weather conditions, or under other conditions that limit visibility. In some embodiments the fluorescent color is present throughout the physical composition of the pole body 12. Alternatives include those wherein the fluorescent color is applied to the exterior surface of the pole body 12. Alternative embodiments include those wherein the pole body 12 is any color including those that are not bright or fluorescent.

Figure 1A:
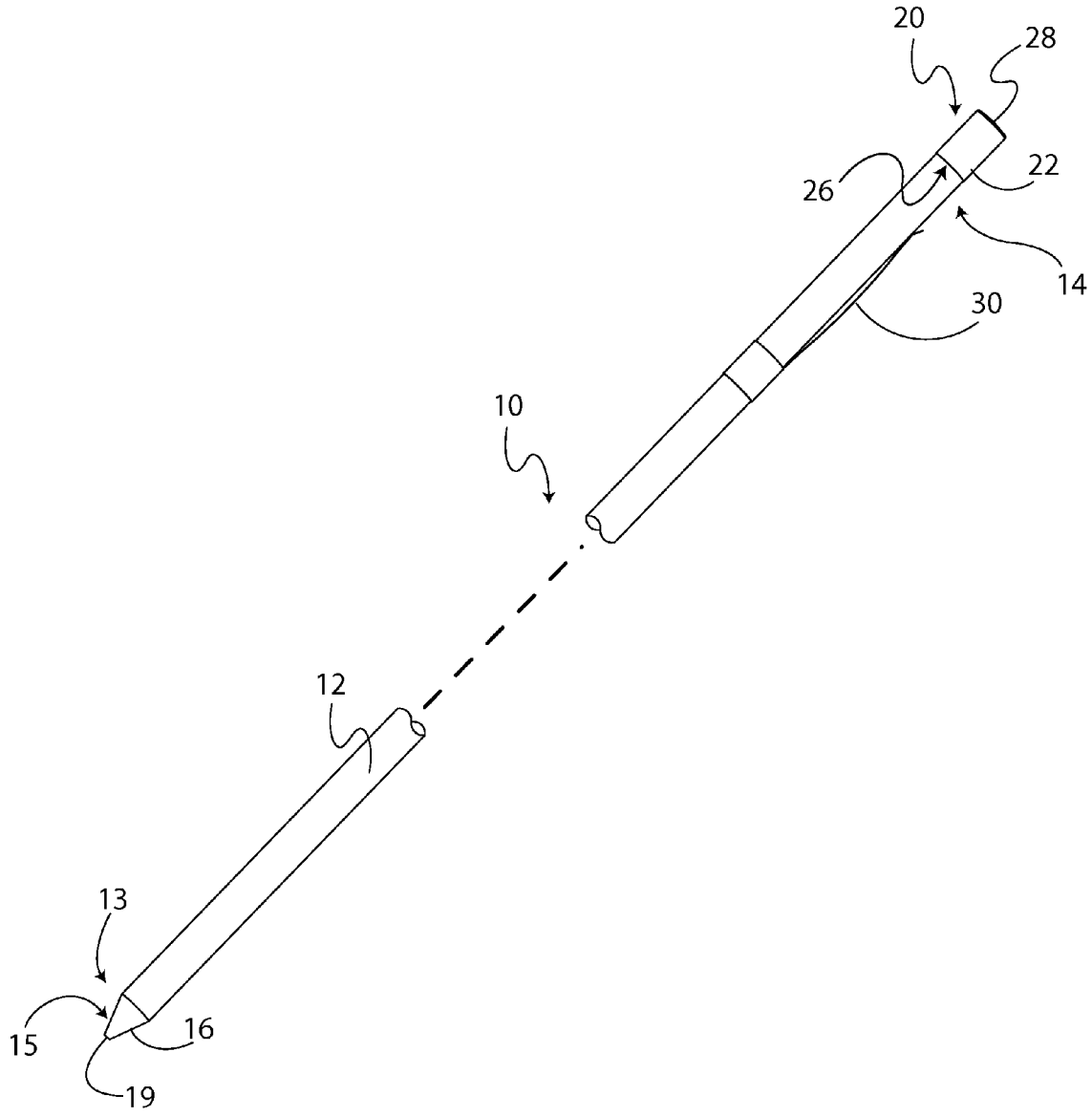
FIG. 1*a* is a perspective view of a caution pole with a generally flat end surface according to multiple embodiments and alternatives.

The pole body 12 includes a proximate end portion 13 as defined by a tapered end portion 15 having generally conical walls 16 for insertion into a support medium such as, for example, the earth and media associated thereto such as snow or the ground. Embodiments include those wherein the tapered end portion 15 includes a pointed tip 18. As shown in FIG. 1*a*, in some embodiments, the tapered end portion 15 includes a generally flat end surface 19 disposed at the proximate end portion 13 of the pole body 12. Alternatives include those wherein the tapered end portion 13 of the proximate end portion 15 of the pole body 12 includes any suitable shape such as, for example, a rounded tip. The pole body 12 extends along the generally longitudinal axis A thereof. This configuration allows reversible and removable insertion of the caution pole 10 into the support medium. Upon reversible and removable insertion of the caution pole 10 into the support medium, at least a portion of the pole body 12 is disposed outside of the support medium. The tapered end portion 15 provides a small pressure surface for snow or ground contact to thereby enhance the ability of a user to force the caution pole 10 into the snow or ground. The configuration of the tapered end portion 15 allows for ease of repeated driving insertion into the support medium. Further, the relative bluntness of the caution pole 10 piles up snow or dirt ahead of the caution pole 10 more rapidly than a more gradual taper and therefore helps to prevent over-insertion of the caution pole 10. The slope of the tapered end portion 15 forms an angle of greater than forty-five degrees from the centerline longitudinal axis A of the pole body 12.

The pole body 12 includes a distal end portion 14. Embodiments include those wherein the upper surface 14*a* of the distal end portion 14 of the pole body 12 is generally flat. Alternative embodiments include those wherein the upper surface 14*a* of the distal end portion 14 of the pole body 12 is formed with a rough surface such as may be left by a saw or machine cut. Embodiments further include those wherein the pole body 12 is approximately 3 to 4 feet long and one-quarter to one-half inch in diameter.

Embodiments and alternatives are provided having an impact cap 20 disposed at the distal end portion 14 of the pole body 12 thereby being placed at the end opposite the tapered end portion 15. The impact cap 20 includes a cylindrical wall 22. The impact cap 20 and cylindrical wall 22 define an internal cavity 24 which internal cavity 24 further includes an access opening 26 into which the distal end portion 14 of the pole body 12 projects. The impact cap 20 includes a substantially planar surface opposing the access opening 26. Embodiments include those wherein the access opening 26 provides access to the internal cavity 24 of the cylindrical walls 22. A nail-head surface 28, comprising a generally flat end panel, is formed integrally with the cylindrical wall 22 to ultimately form the impact cap 20. Some embodiments of the nail-head surface 28 have a substantially planar surface. As desired, the diameter of the internal cavity 24 is selected to be slightly larger than the diameter of the pole body 12 such that the distal end portion 14 of the pole body 12 fits snugly within the internal cavity 24. As seen in the Figures, in some embodiments, the impact cap 20 is fitted over the distal end portion 14 of the pole body 12 in a snug, friction-fitting manner. In some embodiments, the planar surface of the impact cap 20 opposing the access opening 26 is in substantial contact with the upper surface 14*a* of the distal end portion 14 of the pole body 12 when the impact cap 20 is fitted over the distal end portion 14 of the pole body 12. The impact cap 20 is generally undeformable and generally unbreakable thereby providing durability and facilitating repeated and continued use of the caution pole 10 year after year. The generally undeformable and generally unbreakable impact cap 20 allows the user to drive the caution pole 10 into the ground by applying force directly to the impact cap 20. Therefore, it will further be readily understood that the material composition of the impact cap 20 relates directly to mechanical function of driving the caution pole 10 into the ground and not merely to ornamentation.

Figure 3:
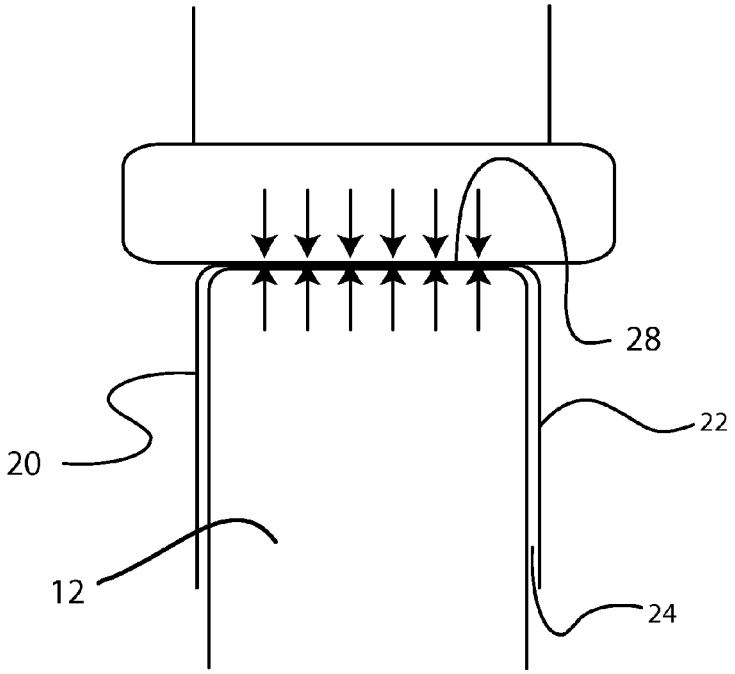
FIG. 3 is a side cutaway view of an end portion of the caution pole illustrated in FIG. 1, illustrating force distribution at a moment of impact.

As seen in FIG. 3, providing the nail-head surface 28 in combination with the cylindrical wall portion 22, forms an effective impact structure to receive blows from a hammer or other driving implement and to distribute the resultant forces effectively. As shown, the impact cap 20 has a generally cylindrical profile. The impact force is substantially evenly transmitted to the caution pole 10. FIG. 3 illustrates the even distribution of forces from a hammer blow along the nail-head surface 28. Upon receiving impact force from a driving implement, the impact cap 20 distributes the impact force evenly over the caution pole 10, thereby achieving enhanced efficiency and reduced force transmission sequentially from the driving implement, to the flat nail head surface 28 of the impact cap 20, to the planar surface of the impact cap 20, and to the distal end portion 14 of the pole body 12 during reversible and removable insertion of the caution pole 10 into a support medium.

It should be understood that while the present application discusses embodiments in terms of being hammer-driven, any driving implement may be used to drive the present caution pole 10 into the support medium such as snow or ground. Embodiments are provided wherein any driving implement will suffice to apply force to the impact cap 20 sufficient to drive the pole 12 into the support medium. Alternatives include those wherein a driving implement such as, for example, a blunt instrument to include a hammer, achieves the best force distribution over the nail-head surface 28. Other embodiments and alternatives are provided wherein other objects may be used to provide force sufficient to drive the pole 12 into the support medium as needed or as desired by a user.

In operation, a user may take a hammer or other driving implement to the impact cap 20 to drive the caution pole 10 into the support medium. In some embodiments, usually one or two blows are sufficient to drive the caution pole 10 sufficiently into the snow or into the ground. The high visibility surface enhances the ability for others to see the caution pole 10 and thus become alert to a hazard. The impact cap 20 provides the ability to drive the caution pole 10 into the snow or ground to the extent that it will typically not blow over or become unstable under adverse circumstances. Further, in some embodiments, the impact cap 20 prevents the upper surface 14*a* of the distal end portion 14 of the pole body 12 from splintering, mushrooming or deforming upon receiving force from a driving implement.

Figure 2:
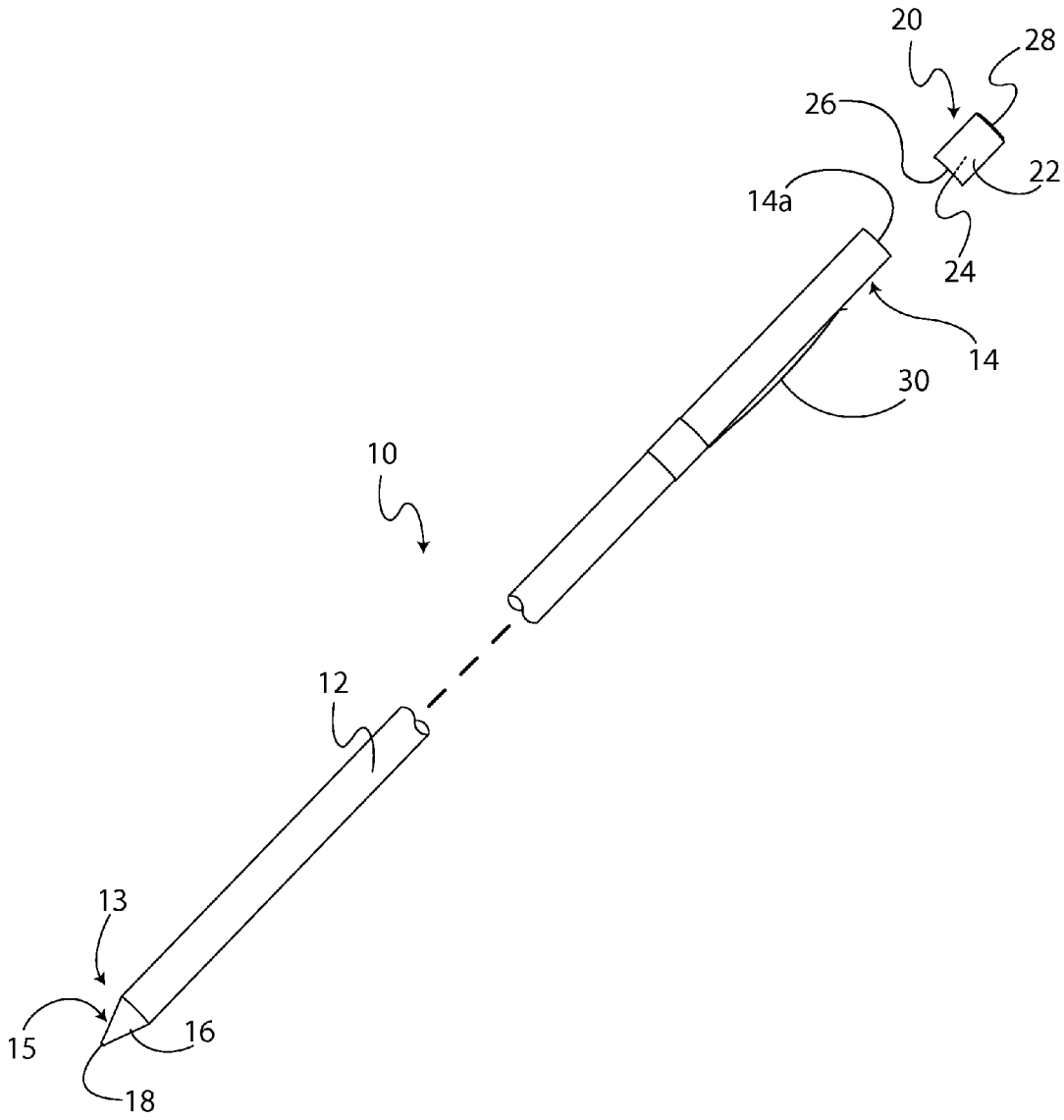
FIG. 2 is an exploded view of the caution pole illustrated in FIG. 1.
Figure 4:
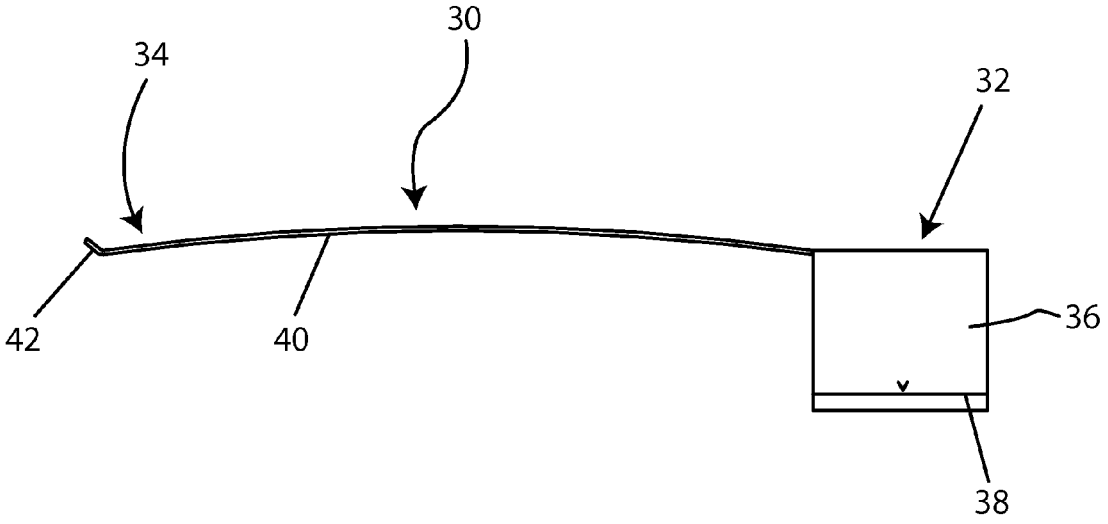
FIG. 4 is a side elevation view of a clip according to multiple embodiments and alternatives.
Figure 5A:
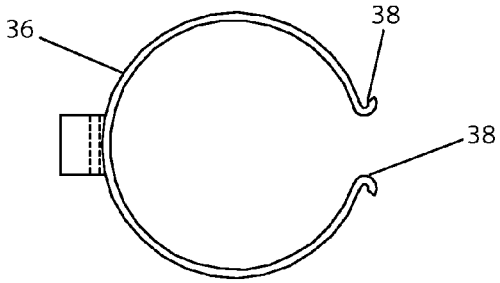
FIG. 5*a* is a plan view of a clip according to multiple embodiments showing two base tabs.

Embodiments include those wherein the caution pole 10 includes a clip 30 disposed on the pole body 12 as shown in FIG. 1. With reference to FIG. 4, the clip 30 has a clip proximate end portion 32 and a clip distal end portion 34. The clip proximate end portion 32 is defined by a base 36. With reference to FIG. 5*a*, some embodiments include those wherein the base 36 as viewed in cross-section profile, has an arched profile capable of receiving the pole body 12. In some embodiments, the base 36 has base tabs 38 which assist in allowing the base 36 to slip onto the pole body 12 as shown in FIG. 5*a*. Alternatives provide that the clip 30 may be selectably clipped directly to the pole 12 at any location along the pole, without a need for sliding the clip 30 once attached to the pole 12, as desired by a user. Other embodiments having an arched profile allow for a user to either clip, then slide the clip 30 or alternatively, to not clip, but instead, to slide the clip 30 onto the pole 12 from either end and then move the clip 30 in sliding to any point along the pole 12 as desired by a user. As to orientation of the clip 30 on the pole body 12, as shown in FIGS. 1 and 2, embodiments provide that the clip 30 may be selectably disposed on the pole body 12 such that the clip distal end portion 34 is oriented towards, being closer than the base 36 to, the distal end portion 14 of the pole body 12. Alternatives provide that the clip 30 is oriented, as desired by a user, in the opposite direction (this orientation not shown in the Figs.), being closer than the base 36 to the proximate end portion 13 of the pole body 12.

Figure 5B:
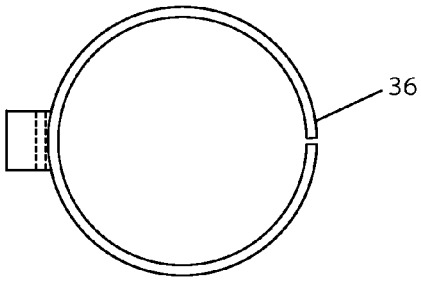
FIG. 5*b* is a plan view of a clip with a cross-section profile of an incomplete cylinder according to multiple alternative embodiments.
Figure 5C:
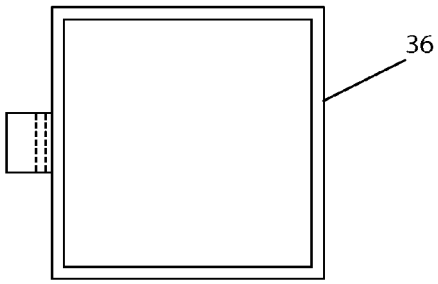
FIG. 5*c* is a plan view of a clip with a cross-section profile of a cube according to multiple alternative embodiments.
Figure 5D:
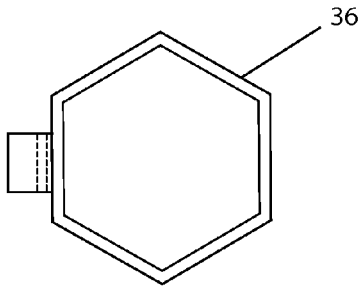
FIG. 5*d* is a plan view of a clip with a cross-section profile of a hexagonal cylinder according to multiple alternative embodiments.
Figure 5E:
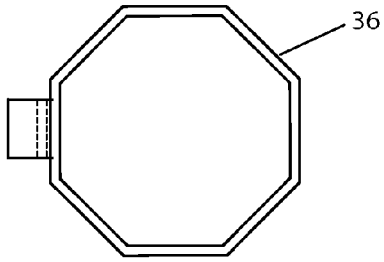
FIG. 5*e* is a plan view of a clip with a cross-section profile of an octagonal cylinder according to multiple alternative embodiments.
Figure 5F:
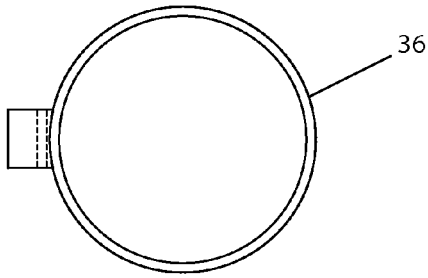
FIG. 5*f* is a plan view of a clip with a cross-section profile of a cylinder according to multiple alternative embodiments.
Figure 5G:
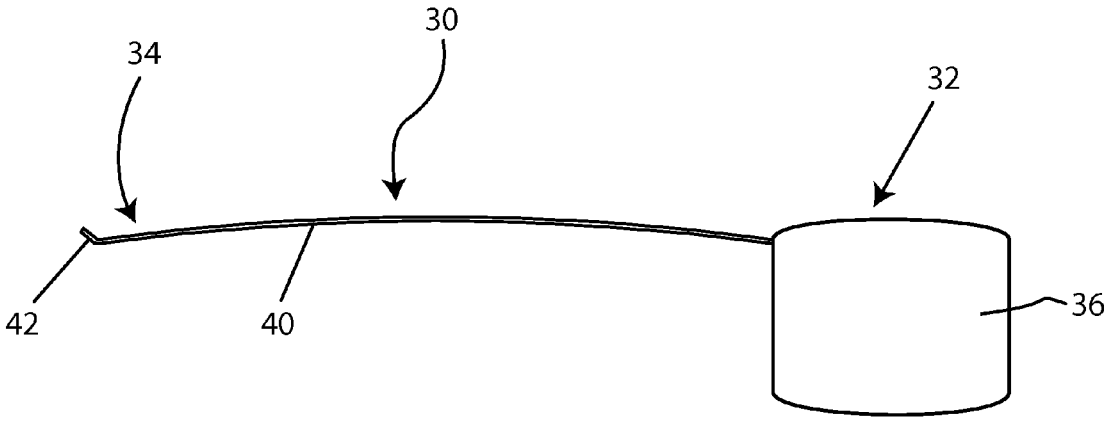
FIG. 5*g* is a side elevation view of a clip with a cross-section profile of a barrel according to multiple alternative embodiments.
Figure 5H:
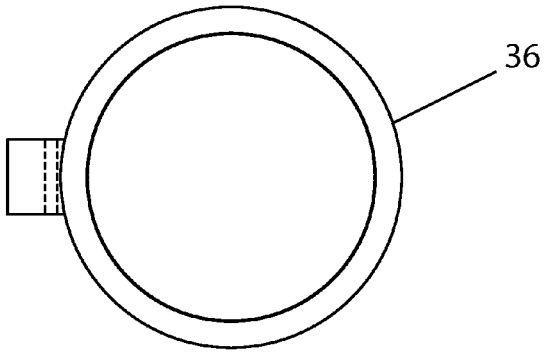
FIG. 5*h* is a plan view of a clip with a cross-section profile of a barrel according to multiple alternative embodiments.

With reference to FIG. 5*b*, alternative embodiments include those wherein the base 36 is formed in cross-section profile of an incomplete cylinder such that the base 36 is capable of selectably sliding onto the pole body 12 as desired over the proximate end portion 13 of the pole body 12 or over the distal end portion 14 of the pole body 12 thereby allowing a user to remove the clip 30 from the caution pole 10 or to attach the clip 30 to any location on the pole body 12 as desired and as selectably chosen by a user. Alternatives include those wherein the base 36 is formed in cross-section profile comprised of a shape which provides sufficient contact area between the base 36 and the pole body 12 in order to secure the base 36 to the pole body 12 such as, for example and with reference to FIGS. 5*c* through 5*f*, those wherein the base 36 is a cube, a hexagonal cylinder, an octagonal cylinder, or a cylinder. As shown in FIGS. 5*g* and 5*h*, embodiments are provided wherein the base 36 takes the shape in general of a barrel.

Embodiments include those wherein the base 36 is attached to the pole body 12 by attachment means such as, for example, friction-fit, glue, adhesive, dowel, rivet, pin, screw, bolt, fastener, or any other suitable means for attaching the base 36 to the pole body 12.

With reference back to FIG. 4, multiple embodiments include those wherein the distal end portion 34 is defined by an arm 40 which extends from the base 36. In some embodiments, the clip 30 further includes an arm tab 42 disposed on the arm 40 at the distal end portion 34 of the clip 30. Embodiments include those wherein the arm tab 42 flares from the arm 40 away from the pole body 12. Alternatives include those wherein the arm tab 42 flares from the arm 40 toward the pole body 12. Embodiments include those wherein the clip 30 comprises the only protrusion on the sides of the pole body 12.

Figure 6:
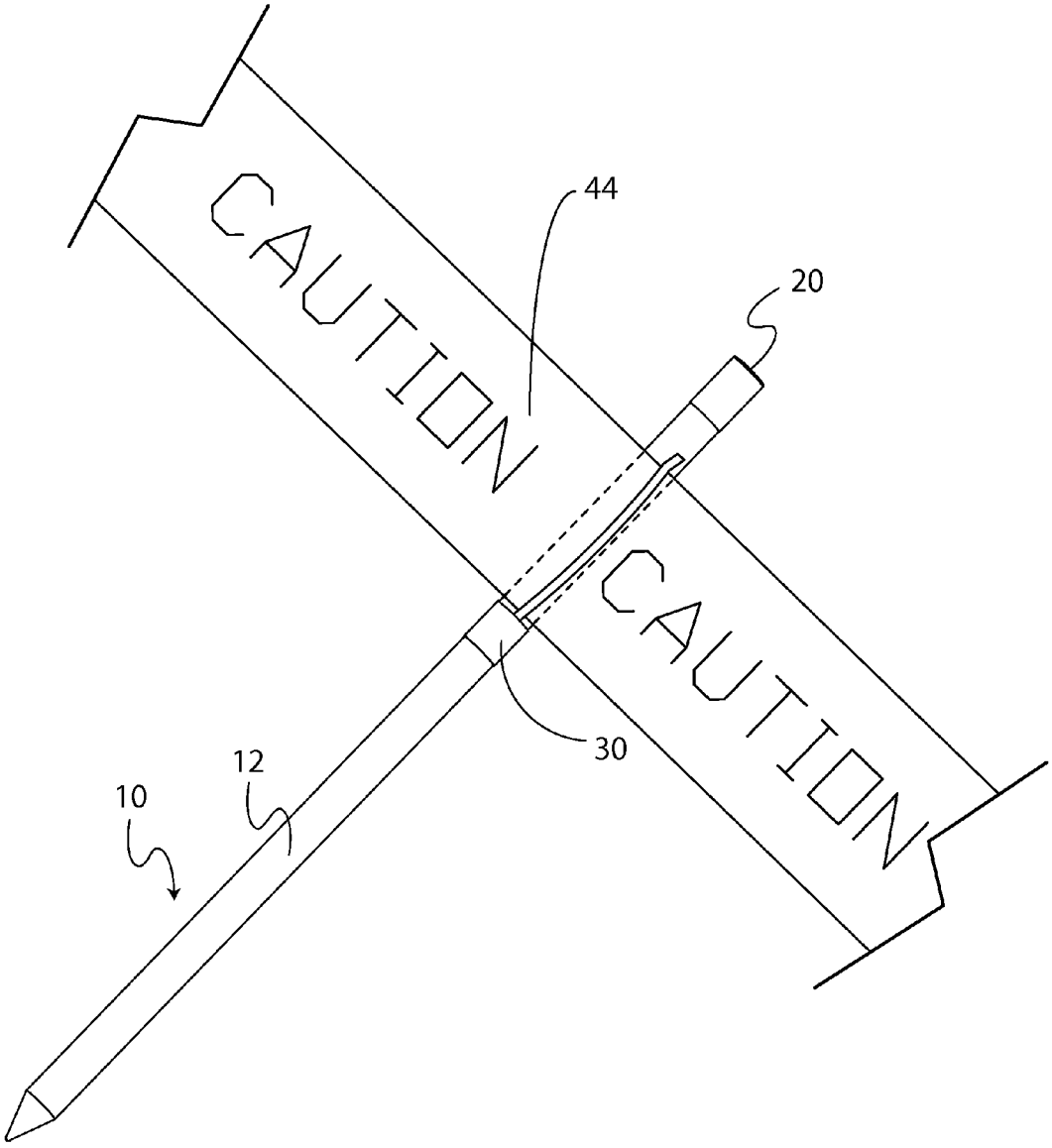
FIG. 6 is a perspective view of a caution pole showing an attachment secured thereto.

With reference to FIG. 6, in multiple embodiments, the clip 30 secures an attachment 44, such as, for example, barricade or caution tape, to the caution pole 10. The attachment 44 is held in place by the arm 40 such that the caution pole 10 supports the attachment 44. The attachment 44 is secured to the clip 30 such that the clip 30 is capable of retaining the attachment 44 upon the application of a force to the attachment 44 such as, for example, wind or a person or moving object bumping into or pressing against the attachment 44. The clip 30 allows a user to forgo securing the attachment 44 to a preexisting structure, such as, for example, a street sign or tree and to display the attachment 44 solely by the use of caution poles 10 having clips 30, thereby allowing the user to select the optimal location for displaying the attachment 44. As desired by a user, the attachment 44 is arranged by the use of caution poles 10 with clips 30 in combination with preexisting structures as selected by a user. The arm tab 42 aids in preventing the attachment 44 from dislocating from the clip 30 and the caution pole 10. Embodiments of the present invention allow a user to mark off a potentially hazardous area or erect a visible warning in a location selectably chosen by the user by securing the attachment 44 to at least one caution pole 10 in combination with other structures as chosen by the user such as, for example, additional caution poles 10 or preexisting structures.

Embodiments include those wherein the clip 30 is comprised of substantially metal material. Alternatively, the clip 30 is comprised of any material suitable for securing the attachment 44 such as, for example, plastic or rubber. As seen in the Figures, embodiments include those wherein the caution pole 10 consists of no more than three parts: the pole body 12, the impact cap 20, and the clip 30.

By the above, the embodiments and alternatives provide an effective low-cost, lightweight caution pole with the ability to be driven by hammer or other driving implement and the ability to secure an attachment such as barricade or caution tape.

It will therefore be readily understood by those persons skilled in the art that the present embodiments and alternatives are susceptible of a broad utility and application. While the present embodiments and alternatives are described in all currently foreseeable embodiments, there may be other, unforeseeable embodiments, alternatives and adaptations of the present embodiments and alternatives, as well as variations, modifications and equivalent arrangements, that do not depart from the substance or scope of the present invention. The foregoing disclosure is not intended or to be construed to limit the present embodiments and alternatives or otherwise to exclude such other embodiments, adaptations, variations, modifications and equivalent arrangements, the present embodiments and alternatives being limited only by the description provided herein, the claims appended hereto and the equivalents thereof.

What is claimed is:

1. A caution pole comprising:

a generally elongate pole body;

a generally undeformable and generally unbreakable impact cap;

a clip disposed on the pole body;

the pole body having a proximate end portion and a distal end portion, the proximate end portion formed with a tapered end portion for insertion into a support medium, the distal end portion formed to have a generally planar upper surface and further formed in a generally cylindrical profile to receive the impact cap;

the impact cap having a flat nail head surface;

the impact cap formed to have a generally cylindrical body having an access opening correspondingly formed to receive the distal end portion of the pole body on one end thereof, and a substantially planar surface opposing the access opening, the impact cap being fitted over the distal end portion of the pole body; and upon receiving impact force from a driving implement, the impact cap distributing the impact force evenly over the pole, thereby achieving enhanced efficiency and reduced force transmission sequentially from the driving implement, to the flat nail head surface of the impact cap, to the planar surface of the impact cap, and to the distal end portion of the pole body during reversible and removable insertion of the caution pole into a support medium, wherein the clip includes a clip proximate end portion and a clip distal end portion, the clip having a base disposed at the clip proximate end portion and an arm extending from the base, wherein the base is formed to wrap around the pole body and the shape of the base is chosen from the group cylinder, cube, hexagonal cylinder, octagonal cylinder, and barrel and wherein the clip comprises the only protrusion on the sides of the pole body.

2. A caution pole according to claim 1 wherein the base has an arched profile capable of receiving the pole body.

3. A caution pole according to claim 1 wherein the base has two base tabs.

4. A caution pole according to claim 1 wherein the base includes a means for attaching the base to the pole body.

5. A caution pole according to claim 1 wherein the clip has an arm tab disposed on the arm at the distal end portion of the clip.

6. A caution pole according to claim 1 wherein the clip distal end portion is oriented towards the distal end portion of the pole body.

7. A caution pole according to claim 1 wherein upon reversible and removable insertion of the caution pole into the support medium, at least a portion of the pole body is disposed outside of the support medium.

8. A caution pole according to claim 1 wherein the pole body and the impact cap are formed from materials of substantially constant physical composition throughout their structure; the physical composition of the pole body is that of a substantially plastic material and the physical composition of the impact cap is that of a substantially metal material.

9. A caution pole according to claim 8 wherein the physical composition of the pole body is that of a substantially plastic material chosen from the group polymers and fiberglass.

10. A caution pole according to claim 9 wherein the substantially plastic material has a further physical composition chosen from the group fluorescent and brightly colored; being further chosen from the group: present throughout the physical composition and applied to an exterior surface of the generally elongate pole body.

11. A caution pole according to claim 1 wherein the planar surface is in substantial contact with the upper surface of the distal end portion of the pole body when the impact cap is fitted over the distal end portion of the pole body.

12. A caution pole according to claim 1 wherein the proximate end portion of the pole body is formed with a taper greater than forty-five degrees from a centerline longitudinal axis of said pole body.

13. A caution pole according to claim 1 wherein the tapered end portion includes a pointed tip.

14. A caution pole according to claim 1 wherein the tapered end portion includes a generally flat end surface.

15. A caution pole according to claim 1 wherein the length of the pole body is between about 3 feet and about 4 feet and the width of the pole body is between about ¼ inch and about ½ inch.

16. An improvement to a caution pole, the improvement consisting of:

the caution pole comprising a generally elongate pole body, a generally undeformable and generally unbreakable impact cap, and a clip disposed on the pole body;

the pole body having a proximate end portion and a distal end portion, the proximate end portion formed with a tapered end portion for insertion into a support medium, the distal end portion being formed to have a generally planar upper surface and further formed in a generally cylindrical profile to receive the impact cap;

the impact cap having a flat nail head surface;

the impact cap being formed to have a generally cylindrical body having an access opening correspondingly formed to receive the distal end portion of the pole body on one end thereof, and a substantially planar surface opposing the access opening, the impact cap being fitted over the distal end portion of the pole body; and upon receiving impact force from a driving implement, the impact cap distributing the impact force evenly over the pole, thereby achieving enhanced efficiency and reduced force transmission sequentially from the driving implement, to the flat nail head surface of the impact cap, to the planar surface of the impact cap, and to the distal end portion of the pole body during reversible and removable insertion of the caution pole into a support medium, wherein the clip includes a clip proximate end portion and a clip distal end portion, the clip having a base disposed at the clip proximate end portion and an arm extending from the base, wherein the base is formed to wrap around the pole body and the shape of the base is chosen from the group cylinder, cube, hexagonal cylinder, octagonal cylinder, and barrel, and wherein the clip comprises the only protrusion on the sides of the pole body.

17. An improvement to a caution pole according to claim 16 wherein the base has an arched profile capable of receiving the pole body.

18. An improvement to a caution pole according to claim 16 wherein the base has two base tabs.

19. An improvement to a caution pole according to claim 16 wherein the base includes a means for attaching the base to the pole body.

20. An improvement to a caution pole according to claim 16 wherein the clip has an arm tab disposed on the arm at the distal end portion of the clip.

21. An improvement to a caution pole according to claim 16 wherein the clip distal end portion is oriented towards the distal end portion of the pole body.

22. An improvement to a caution pole according to claim 16 wherein upon reversible and removable insertion of the caution pole into the support medium, at least a portion of the pole body is disposed outside of the support medium.

23. An improvement to a caution pole according to claim 16 wherein the pole body and the impact cap are formed from materials of substantially constant physical composition throughout their structure; the physical composition of the pole body is that of a substantially plastic material and the physical composition of the impact cap is that of a substantially metal material.

24. An improvement to a caution pole according to claim 23 wherein the physical composition of the pole body is that of a substantially plastic material chosen from the group polymers and fiberglass.

25. An improvement to a caution pole according to claim 24 wherein the substantially plastic material has a further physical composition chosen from the group fluorescent and brightly colored; being further chosen from the group present throughout the physical composition and applied to an exterior surface of the generally elongate pole body.

26. An improvement to a caution pole according to claim 16 wherein the planar surface is in substantial contact with the upper surface of the distal end portion of the pole body when the impact cap is fitted over the distal end portion of the pole body.

27. An improvement to a caution pole according to claim 16 wherein the proximate end portion of the pole body is formed with a taper greater than forty-five degrees from a centerline longitudinal axis of said pole body.

28. An improvement to a caution pole according to claim 16 wherein the tapered end portion includes a pointed tip.

29. An improvement to a caution pole according to claim 16 wherein the tapered end portion includes a generally flat end surface.

30. An improvement to a caution pole according to claim 16 wherein the length of the pole body is between about 3 feet and about 4 feet and the width of the pole body is between about ¼ inch and about ½ inch.

* * * * *